US010684011B2

(12) United States Patent
Seitler, Jr.

(10) Patent No.: US 10,684,011 B2
(45) Date of Patent: Jun. 16, 2020

(54) HANDHELD STORAGE TUBE HAVING AN EXTERNALLY INTEGRATED FIRESTARTER

(71) Applicant: Samuel L Seitler, Jr., Grand Rapids, MI (US)

(72) Inventor: Samuel L Seitler, Jr., Grand Rapids, MI (US)

(73) Assignee: Samuel Lee Seitler, Jr., Grand Rapids, MI (US)

( * ) Notice: Subject to any disclaimer, the term of this patent is extended or adjusted under 35 U.S.C. 154(b) by 113 days.

(21) Appl. No.: 15/994,985

(22) Filed: May 31, 2018

(65) Prior Publication Data

US 2019/0011127 A1 Jan. 10, 2019

Related U.S. Application Data

(60) Provisional application No. 62/529,535, filed on Jul. 7, 2017.

(51) Int. Cl.

| | |
|---|---|
| ***F23Q 1/06*** | (2006.01) |
| ***F23Q 2/22*** | (2006.01) |
| ***A45C 13/00*** | (2006.01) |
| ***A45C 15/00*** | (2006.01) |

(52) U.S. Cl.

CPC ..... *F23Q 1/06* (2013.01); *A45C 13/008* (2013.01); *A45C 15/00* (2013.01); *F23Q 2/22* (2013.01); *A45F 2200/0566* (2013.01)

(58) Field of Classification Search

CPC ..... F23Q 1/06; F23Q 2/22; F23Q 1/00; A45F 2200/0566

See application file for complete search history.

(56) References Cited

U.S. PATENT DOCUMENTS

| | | | | |
|---|---|---|---|---|
| 4,698,068 | A * | 10/1987 | Jensen | C10L 11/00 431/269 |
| 5,580,239 | A * | 12/1996 | Jang | B43K 29/16 401/195 |
| 2012/0009004 | A1* | 1/2012 | Chu | B43K 5/005 401/195 |
| 2017/0299180 | A1* | 10/2017 | Holland | F23Q 2/22 |
| 2018/0031234 | A1* | 2/2018 | Falkenhayn | F23Q 1/06 |

* cited by examiner

*Primary Examiner* — Daniel J Colilla

(57) ABSTRACT

A handheld survival tool that incorporates a storage tube and a firestarting device into one ergonomic unit. Tinder and small survival items are stored within the device while a ferrocerium rod and scraper are stored externally. The replaceable scraper is fastened to one of the storage tube caps which allows the storage tube to be used as a handle for holding the scraper which greatly increases directional control while generating sparks. The ferrocerium rod is tethered to the opposite storage tube cap and secured within a sheath which prevents loss of the ferrocerium and provides a larger mechanism for holding the ferrocerium rod during spark generation. This device greatly improves upon the use, reliability, and function of prior fire-starting devices.

1 Claim, 3 Drawing Sheets

HANDHELD STORAGE TUBE HAVING AN EXTERNALLY INTEGRATED FIRESTARTER

CROSS-REFERENCE TO RELATED APPLICATIONS

| | | |
|---|---|---|
| 9,506,650 | Nov. 29, 2016 | Abrahamer |
| 9,404,653 | Aug. 2, 2016 | Putrello, Jr. |
| 8,967,899 | Mar. 3, 2015 | Chu, et al. |
| 8,186,995 | May 29, 2012 | Putrello, Jr. |
| 5,919,037 | Jul. 6, 1999 | Brillhart, III, et al. |
| 5,645,415 | Jul. 8, 1997 | Hamel |
| 5,580,239 | Dec. 3, 1996 | Jang |
| 5,279,628 | Jan. 18, 1994 | Hutchens, et al. |
| 5,214,853 | Jun. 1, 1993 | Bray, et al. |
| 4,770,669 | Sep. 13, 1988 | Allen, et al. |
| 4,698,068 | Oct. 6, 1987 | Jensen |
| 4,188,192 | Feb. 12, 1980 | Levenson, et al. |

BACKGROUND OF THE INVENTION

This application is a non-provisional application of previously filed U.S. provisional application No. 62/529,535 which was filed on Jul. 7, 2017.

This invention pertains to hand-held survival tools and in particular, storage of small survival items and firestarters.

While venturing into the wilderness, it is crucial to have at least a minimum amount of survival items on hand. Should a situation arise where one finds themself lost in the wilderness, having a small stash of survival items can mean the difference between life and death. Having a store of survival items on hand is not enough though. These survival items need to be reliable, high performing, and easy to operate.

Today, survival kits are available in a myriad of shapes and sizes; all of which generally contain similar survival items stored within some sort of storage vessel. A handy and popular version being the cylindrical waterproof cases for which someone can store matches, medication, fishing hooks, etc. Others are simply a plastic box stuffed with survival items. The downside to these, is that the containers have a very limited amount of storage space.

Of all the survival items an individual may carry into the wilderness, a reliable means of making fire is absolutely indispensable. In certain circumstances, one night spent in the wilderness without fire can be deadly. Therefore, whatever means the user decides to use in creating fire, it must be easy to operate, functional, and highly reliable. There are numerous fire starting devices available: matches, waterproof matches, cigarette lighters, barbeque lighters, flint and steel, and of course the ferrocerium rod and scraper. Although these items may be capable of creating fire, all of these fire starting devices have intrinsic flaws. Matches do not work if they get wet. Waterproof matches work when wet, but still can only light a limited number of fires. Cigarette lighters and barbeque lighters consume fuel and are notorious for mechanical failure. Flint and steel, although impervious to water is very difficult to use. The ferrocerium rod and scraper, although simple, durable, and capable of lighting a lifetime of fires, can be quite small, making it difficult to use and offering little or no ability to store tinder, and the process of quickly striking the scraper against the stationary flint rod often results in the user knocking over the tinder pile and/or generating sparks that are difficult to direct into the tinder pile.

After looking at the shortcomings of available fire making devices, including the ferrocerium rod and scraper, along with the importance of carrying small survival items; it is apparent that there is an unfulfilled need for a single ergonomic device that combines the flint rod and scraper's simple design and reliability, with a storage container having a maximized amount of storage space for tinder and small survival items.

The invention disclosed herein fulfills all of the unfulfilled needs listed above.

BRIEF SUMMARY OF THE INVENTION

It is the object of this invention to provide a survival device that incorporates a handheld storage tube and a ferrocerium rod and scraper firestarter, into one ergonomic unit. Another object of this invention is to provide a survival device that has a maximized internal storage area, for small survival items and enough tinder to create multiple fires until such a time that the tinder can be replenished from natural sources found in the wilderness. It is also the object of this invention to improve upon prior fire making devices by providing a survival device that produces a well-controlled and directed amount of concentrated sparks, thus eliminating the tendency of the ferrocerium and scraper to cast off an undirectable and ever dispersing shower of sparks, and to eliminate the tendency for the user to inadvertently bump and scatter the tinder pile during spark generation.

The entire internal storage area of the storage tube is designated solely for storage of tinder and small survival items, the internal storage area is maximized by storing the ferrocerium rod and scraper on the outside of the storage tube rather than inside the storage tube with the other survival items. The prior types of ferrocerium rod and scraper's inability to produce a controlled and directed amount of sparks, along with the tendency for the user to inadvertently bump and scatter the tinder pile while generating sparks, is resolved by mounting the scraper, in a removable fashion, to a specifically shaped mounting tab which projects perpendicularly from the end surface of the storage tube's second end cap; and by swively or flexibly linking the ferrocerium rod to the first end cap.

Mounting the scraper near the end of the storage tube, along with the specific shape of the mounting tab, allows the user to use the storage tube itself as a handle to firmly hold the scraper in a stationary and horizontal position above and even against the tinder pile with one hand. Swively linking the ferrocerium rod to the first end cap creates a larger mechanism for the user to hold onto, thus improving grip and control over the ferrocerium rod. When the ferrocerium rod is inserted into the void and then pulled back across the scraper, a thin layer of the ferrocerium rod's surface is scraped off and immediately begins to burn. Since the ferrocerium rod is being pulled back across the stationary scraper, the sparks from the ferrocerium rod lack any sort of momentum which cause all of the sparks to pile up against the face of the scraper and fall directly down into the tinder and ignite the tinder. This invention eliminates the problem the ferrocerium rod and scraper's inability to produce a controlled and directed amount of sparks, along with the tendency for the user to inadvertently bump and scatter the tinder pile while generating sparks.

This invention also addresses the issue of misplacing, losing, and/or forgetting individual fire starting and survival items in several ways. Swivelly linking the ferrocerium rod to the first end cap, reduces the chance that the first end cap will be misplaced or lost while using the ferrocerium rod in the dark or in snowy conditions. Since the first end cap can swivel and rotate independently of the ferrocerium rod, it can be threaded onto and off from the storage tube while the ferrocerium rod is held within the sheath which prevents the ferrocerium rod from sliding out of or being unintentionally removed from the sheath, thus protecting the ferrocerium rod from loss. The combining of the storage tube (which houses the tinder and other small survival items) and the ferrocerium rod and scraper into one unit; greatly reduces the chance of forgetting the otherwise individual items.

The use of this invention is quite simple. When the user of this invention needs to start a fire; they simply unscrew the first cap, slide the ferrocerium rod from the sheath, remove a necessary amount of tinder from the storage tube, place the tinder on the ground, grip the storage tube in one hand with the second end cap and scraper held directly above the tinder pile, insert the ferrocerium rod into the second end cap void, and pull the ferrocerium rod back across the scraper to generate sparks that fall directly into the tinder pile. Once the fire is going, the ferrocerium rod is slid back into the sheath and first end cap is threaded back onto the storage tube.

It should be understood that the invention disclosed herein represents the preferred embodiment of the invention and that the protection granted under a patent would not be lessened due to small changes in the structure and or shape of the invention or its individual parts, such as (but not limited to): alternate forms of sheathing the ferrocerium rod or alternate means of attaching it to the outside surface; alternate forms of linking the ferrocerium rod to the first end cap by utilizing a cord, chain, or D-ring as a swivel linkage etc; the utilization of friction fit end caps rather than threaded caps, or changing the shape of the storage tube to a square, triangular, octagonal shape, etc. As small changes may change the appearance of the invention or the process of making it, they do not in fact change the function, objects, or purpose of the device.

DETAILED DESCRIPTION OF THE INVENTION

Figure 1:
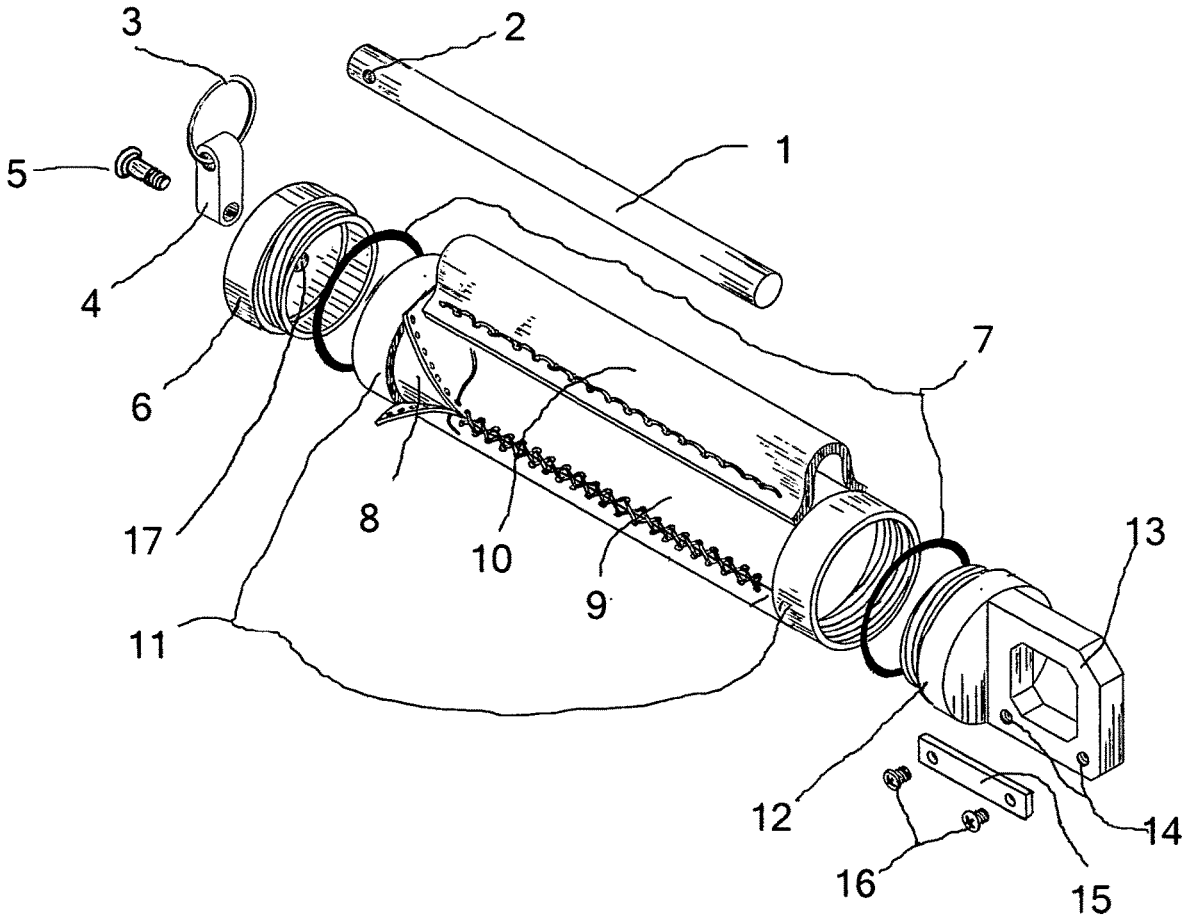
Fig.1 is an exploded isometric view showing the invention in the preferred embodiment in which the invention is machined from aluminum stock and the storage tube having female threads which increase internal storage space, the sheath is made of leather, or other similar material, and the ferrocerium rod is secured to the first end cap by means of a two axis link combined with a split ring.
Figure 2:
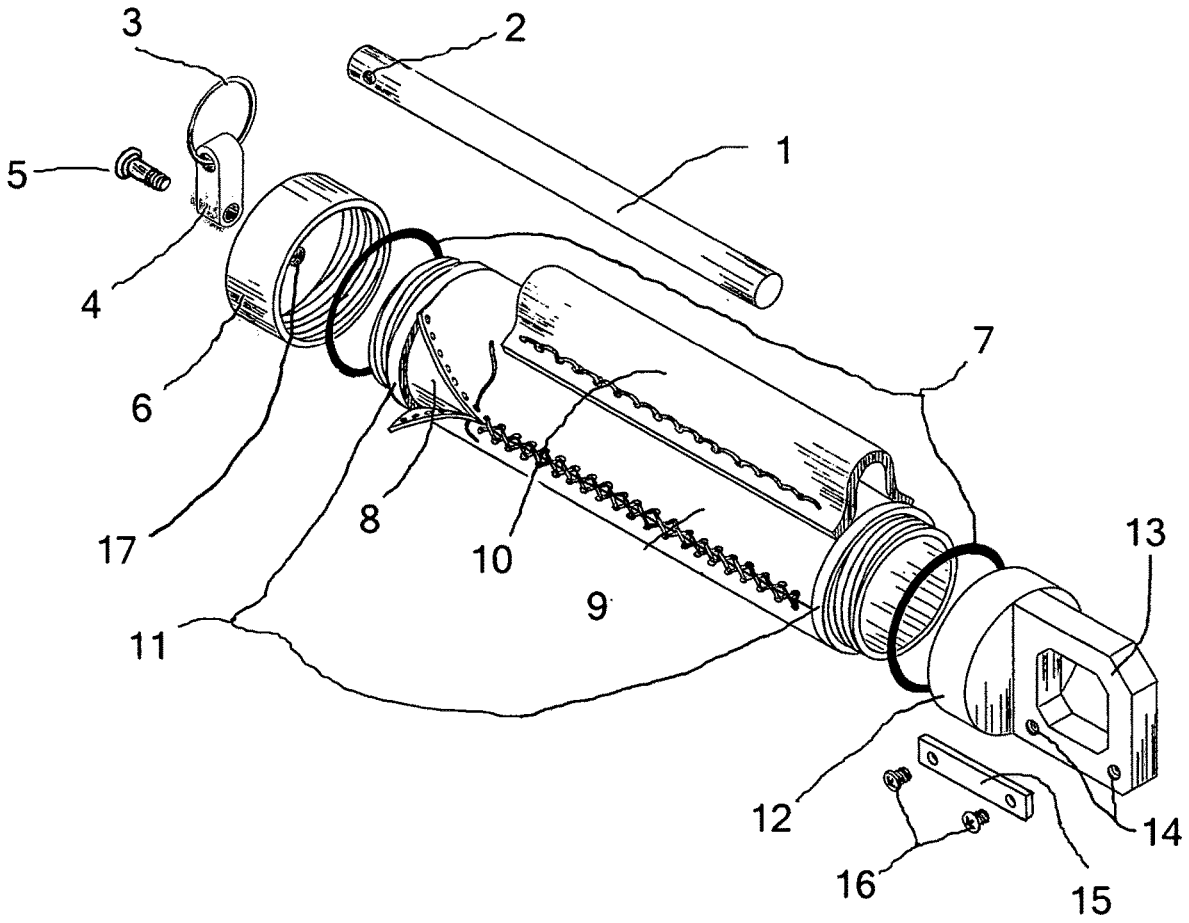
Fig.2 is an exploded isometric view showing the same invention having male threads on the storage tube ends.
Figure 3:
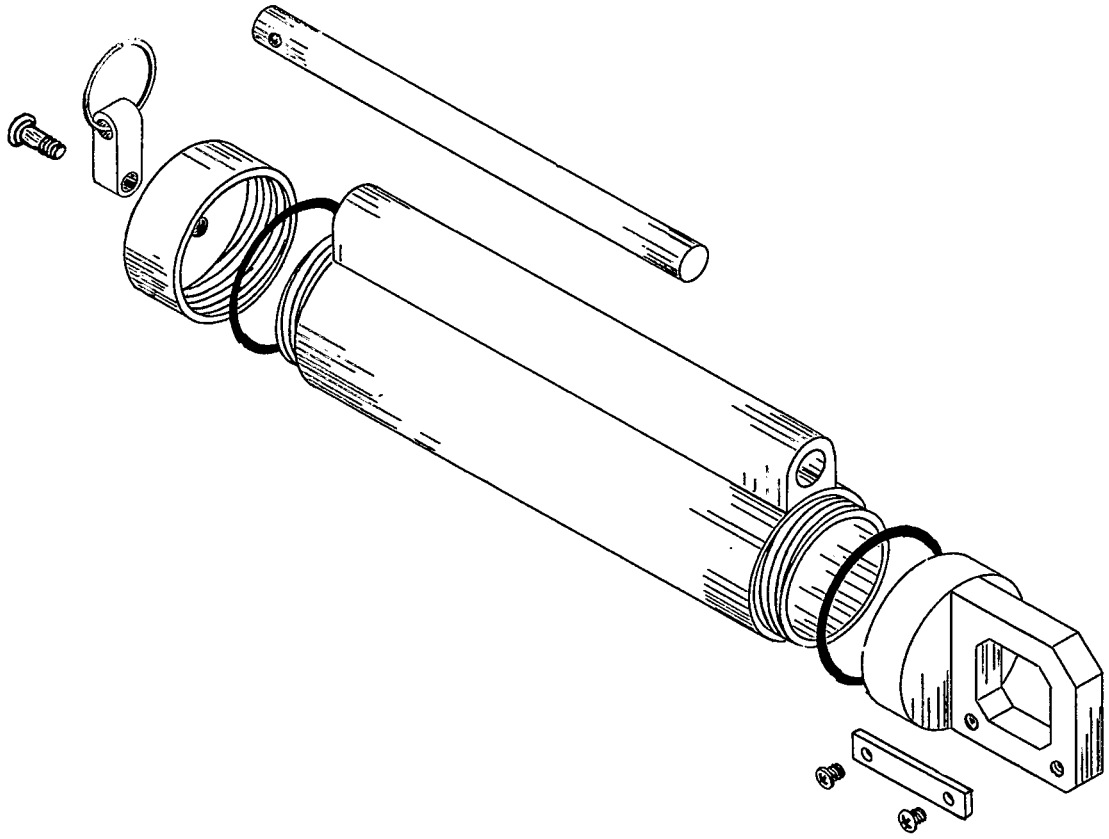
Fig.3 is an exploded isometric view showing the same invention with an alternative sheath 10, in which the sheath 10 and the storage tube 8 are formed together as one unit, either by being welded together, formed through an extrusion process, formed through casting, or other similar manufacturing process. The function and use of both embodiments are identical, and the alternative embodiment shown in Fig.3 is simply to provide a faster and simpler means of manufacturing without deviating from the objects, use, or function of the invention disclosed herein.

With reference to FIG. 1, this invention is shown in its preferred embodiment. This invention is a handheld cylindrical storage tube 8 incorporating; a sheath 10 for the external storage of a ferrocerium rod 1, and an externally mounted and replaceable scraper 15. Each of the storage tube's ends may possess either male or female threads which correspond to and removably mate with the male or female threads of the first end cap 6 and the second end cap 12. The threaded mating of the storage tube 8 and end caps 6 and 12, is made waterproof by incorporating two O-rings 7, which are located at the base of each of the male threads. The central exterior surface area of the storage tube walls is machined down to create the circumferential ribs 11 which prevent the sheath wrap 9 from sliding off of the storage tube 8. The sheath 10, as shown in Fig.1, is formed from a suitably sized and shaped leather piece. The sheath 10 is folded and stitched to the sheath wrap 9, which is formed from a suitably sized and shaped leather piece. The sheath wrap 9 is wrapped around the exterior circumference of the storage tube 8, and its two facing edges are stitched together to secure the sheath wrap 9 around and to the outer surface of the storage tube 8. The ferrocerium rod 1 is secured and stored within the sheath 10 when not in use.

The ferrocerium rod 1, has an attachment hole 2, drilled radially through either end of the ferrocerium rod 1, where a split ring 3 is secured through the attachment hole 2 and to the first end cap swivel 4. The first end cap swivel 4 is fastened with a shoulder bolt 5 into a threaded hole 17 drilled and tapped axially into the flat external surface of the first end cap 6. The means of swively linking the ferrocerium rod 1 and first end cap 6 allows the first end cap 6 to rotate independently of the ferrocerium rod 1 and re-movably mate or un-mate from the threads of the storage tube 8 and prevents the ferrocerium rod 1 from sliding out of the sheath 10 until the first end cap 6 is unthreaded from the storage tube 8; second, the swivel link between the first end cap 6 and ferrocerium rod 1 essentially creates a larger mechanism for the user to grip while using the ferrocerium rod 1; third, the linking of the ferrocerium rod 1 to the first end cap 6 reduces the likelihood of misplacing or losing the ferrocerium rod 1 or the first end cap 6 while using the device.

The second end cap 12 is formed with a scraper mounting tab 13, which extends perpendicularly from the diameter of the flat end surface of the second end cap 12. A void is milled through the center of the face of the scraper mounting tab 13. The void, having adequate dimensions as to retain enough surface area of the face of the scraper mounting tab 13 to permit the mounting of the scraper 15 to the remaining surface area of the face of the scraper mounting tab 13 along the bottom edge of the void, with a portion of the scraper's edge protruding into the void, while also permitting the insertion of the ferrocerium rod 1 through the scraper mounting tab 13 during spark generation.

The scraper mounting tab 13 has two threaded screw holes 14, drilled perpendicularly through its face and along one side of the void to facilitate the mounting of the scraper.

The scraper 15, is flat, rectangular, and made from hardened steel or any other material having the necessary physical characteristics which will allow it generate sparks when scraped along the surface of the ferrocerium rod 1. The scraper 15 is replaceable and re-movably attached to the scraper mounting tab 13 by fitting the two scraper screws 16 through the two threaded screw holes 14 located near each end of the scraper 15 and threading the scraper screws 16 into the threaded screw holes 14 of the scraper mounting tab 13. The scraper 15 can be mounted on either side of the scraper mounting tab 13 for left or right hand use.

When the user of this invention needs to start a fire; they simply unscrew the first end cap 6, slide the ferrocerium rod 1 from the sheath 10, remove a necessary amount of tinder from within the storage tube 8 and place tinder on the ground, grip the storage tube 8 in one hand with the second end cap 12 and attached scraper 15 held directly above the tinder pile, and scrape the ferrocerium rod 1 back across the scraper 15 to generate sparks that fall directly into the tinder pile. Once the fire is going, the ferrocerium rod 1 is slid back inside the sheath 10 and first end cap 6 is rethreaded to the storage tube 8.

I claim:

1. A handheld storage tube comprising:

a storage tube, being an elongated hollow and ridged structure having threads formed at a first end and a second end which correspond and re-movably mate with threads of a first end cap and a second end cap, respectively, to create an enclosed and accessible area within said storage tube;

a replaceable ferrocerium rod, being re-movably linked to said first end cap by means of a swivel;

a sheath, being a second elongated and open ended hollow structure into which said replaceable ferrocerium rod is inserted and stored, said sheath being either a separate structure externally attached parallel to said storage tube's outer curved surface or said sheath being a physical extension of and outer curved surface of said storage tube;

wherein said first end cap is re-movably linked to said replaceable ferrocerium rod by means of a swivel;

wherein second end cap has a flat mounting tab extending perpendicularly from a diameter of a flat end surface of said second end cap, said flat mounting tab having a void milled through a center of a face of said flat mounting tab, wherein the void is dimensioned as to preserve enough surface area of said face of said flat mounting tab as to accommodate;

the mounting of a replaceable scraper to a remaining surface area of said face of said flat mounting along one edge of said void with a portion of an edge of said scraper protruding into said void, and an insertion of said replaceable ferrocerium rod through said void;

wherein said replaceable scraper is flat and elongated with a screw hole near opposite ends of said scraper as to allow said replaceable scraper to be re-movably attached by use of screws to said flat mounting tab of said second end cap; and two replaceable elastomeric gaskets, each gasket being re-movably placed at the base of said threads of said first end cap and said threads of said second end cap, respectively, to create a waterproof seal while said first end cap and said second end cap are fully threaded onto said storage tube.

* * * * *